United States Patent [19]

Gurrera-Folch

[11] 4,155,158

[45] May 22, 1979

[54] APPARATUS FOR WINDING TUBES AROUND A CORE

[75] Inventor: Augustin Gurrera-Folch, Bezons, France

[73] Assignee: Technip, Rueil Malmaison, France

[21] Appl. No.: 850,636

[22] Filed: Nov. 11, 1977

[30] Foreign Application Priority Data

Nov. 19, 1976 [FR] France ..... 76 34954

[51] Int. Cl.[2] ..... B23P 19/04; B23P 15/26; B65H 81/00

[52] U.S. Cl. ..... 29/727; 29/157.3 AH; 242/7.22; 72/66; 72/137; 403/379; 403/324; 187/94

[58] Field of Search ..... 29/157.3 R, 157.3 AH, 29/283.5, 726, 727; 113/118 R; 72/66, 137, 49; 242/7.01, 7.02, 7.21, 7.22; 403/379, 324, 323; 187/20, 26, 94

[56] References Cited

U.S. PATENT DOCUMENTS

| | | | |
|---|---|---|---|
| Re. 25,923 | 12/1965 | Powell | 187/26 |
| 78,829 | 6/1868 | Reedy | 187/21 |
| 730,427 | 6/1903 | Wilson et al. | 242/7.01 |
| 820,507 | 5/1906 | Layne | 242/7.22 |
| 1,408,530 | 3/1922 | Pierce | 403/324 |
| 2,674,084 | 4/1954 | Ratte et al. | 242/7.01 |
| 2,755,725 | 7/1956 | Clark | 403/379 |
| 3,255,976 | 6/1966 | Mede | 242/7.21 |
| 3,380,675 | 4/1968 | Baxter, Jr. et al. | 242/7.21 |
| 3,478,408 | 11/1969 | Brown | 242/7.01 |
| 3,685,865 | 8/1972 | Young | 403/324 |
| 3,703,028 | 11/1972 | Bosquain et al. | 29/429 |
| 3,884,424 | 5/1975 | Bosquain et al. | 242/7.21 |
| 3,988,899 | 11/1976 | Dougherty | 403/379 |

FOREIGN PATENT DOCUMENTS

| | | | |
|---|---|---|---|
| 163668 | 7/1949 | Austria | 242/7.22 |

*Primary Examiner*—Carl E. Hall
*Assistant Examiner*—Daniel C. Crane
*Attorney, Agent, or Firm*—Frishauf, Holtz, Goodman and Woodward

[57] ABSTRACT

A method and a device for winding tubes around a core, for example in the manufacture of heat-exchangers, the device including a single horizontal platform concentric with the core and supporting a plurality of winder assemblies. The platform is movable both in translation and in rotation relative to the core so as to perform the winding of the tubes around the core and along the length of the core in a single operation.

20 Claims, 7 Drawing Figures

APPARATUS FOR WINDING TUBES AROUND A CORE

BACKGROUND OF THE INVENTION

The present invention relates generally to a method and a device for winding tubes around a core in the manufacture of heat-exchangers.

The invention is more particularly concerned with a method of the above type, wherein at least one winder assembly is subjected to a combined translational and rotational movement resulting in the winding of at least one tube around a core.

There are already known heat-exchangers obtained by the afore-mentioned method and comprising a great number of tubes wound to a helical form in a certain number of layers around a core. More precisely, such exchangers were manufactured by positioning a core vertically at the centre of a cabin equipped with a certain number of members, the combined ascending, descending and rotational movements of which ensured the required winding.

The said members were essentially as follows:

a vertically movable platform, a horizontal crown or top member concentric with the core and supported by posts and brackets above the said platform, and four winders spaced 90 degrees from one another, suspended from the said crown and adapted to rotate about said core to allow the tubes to be wound thereon to a helical form.

Such a construction remained quite complicated as regards both its structure and its operation. Indeed the winders moved vertically by rotating between a lower end position and an upper end position, i.e., substantially between the platform and the crown from which the winders were suspended, and when the winders reached the upper end position in proximity to the crown the platform was actuated vertically and automatically so as to raise the whole device along the core and perform the winding around an upper portion of the core.

Such an installation suffered also from a certain number of other disadvantages, for example where large-surface exchangers were required.

The winders suspended from the crown were highly unstable owing to the varying forces to which they were subjected. This resulted in inaccurate winding, repeated adjustments and therefore slow manufacture. Breakage could even occur at the winders and access to the latter was difficult owing to the complexity of the installation described above.

The said disadvantages resulted in frequent damage to the machine and possibly to the tubes themselves during the winding.

Moreover, in regard to a good deal of the production, the excessively large winders allowed for the winding of only two tubes during each upward travel. In addition each suspended winder could wind only one tube during each upward travel of the platform.

It may also be mentioned that the platform arranged concentrically with the core was difficult to dismount as the diameter of the coil increased. Lengthy and frequent winding stoppage was therefore necessary.

The object of the present invention is to remedy all the afore-mentioned drawbacks by providing a winding method and a winding device which are simple and particularly efficient. The device according to the invention allows several layers of tubing to be wound on a core within a very short time and with high accuracy ensuring excellent winding reliability.

SUMMARY OF THE INVENTION

More specifically, the invention has for its object a method for winding tubes around a substantially vertical, stationary core, wherein at least one winder assembly is subjected to a combined translational and rotational movement resulting in the winding of at least one tube on the core, the method being characterized in that the winder assembly is advantageously mounted on a single platform, and the winding of the tube on the core is performed in a single operating step resulting from a continuous translational and rotational movement of the said single platform along the entire height of the core.

Owing to this simple arrangement, any damage to the installation and any of the winding defects that occurred in the prior devices are avoided.

According to another feature of the method of the invention, the single platform may be given either a clockwise or a counter-clockwise rotational movement to allow for the winding of several layers of tubing in one direction or the other alternately.

The invention is also directed to a device for carrying out the above method, wherein winder means is given their simultaneous translational and rotational movements to permit at least one tube to be wound around a core or the like, the winder device comprising a single horizontal platform concentric with the core, supporting at least one winder assembly and movable in translation as well as in rotation.

According to another feature of the invention, the said platform includes a circular table carrying the said winder assembly and rotatably mounted within a vertically movable peripheral member or outer crown.

The working portion of the device according to the invention therefore comprises a platform which includes two members.

According to still another feature of the invention, each winder assembly comprises a reel with which is associated a device for guiding the tube during its winding around the core.

The said guiding device, according to the invention, includes an arm substantially parallel with the platform, one end of which is pivotally mounted on the circular table whereas its other end is pivotally connected to a substantially vertical or upright member supporting a head for guiding round the core the tube proceeding from the reel.

According to another feature of the device of the invention, the said arm is driven by an actuator secured to the circular table in order to apply the guiding head onto the core.

The guiding head, being mounted so as to slide along the said upright member, includes an actuator whose rod actuates a set of rollers which co-operates with a second set of rollers to effect a prebending of the tube.

According to still another feature of the invention, there are provided on the circular table three winder assemblies, each of which is capable of winding on the core three tubes at the same time, each reel and its associated guiding device being positioned on the circular table at an angle of substantially 120 degrees.

The horizontal stabilization of the platform carrying all the working members performing the winding is ensured by cables or chains passing around rollers or the like secured to the afore-said peripheral or crown member and whose ends are anchored to the ground and to the frame forming the cabin for the installation, respectively.

According to still another feature of the invention, the rotation of the circular table is ensured by a hydraulic motor mounted on the said peripheral or crown member, whereas the vertical upward and downward motions of the latter are ensured by actuators whose rod drives a cable or the like attached between the platform and the frame. The control means for the said hydraulic motor as well as the said actuators may be provided, for example, above the platform, on a winder assembly.

It should also be noted that, according to the invention, the guiding and vertical stability of the platform are ensured by members such as counter-weights connected to the platform by cables passing around pulleys, and sliding in rails provided in the posts forming the aforesaid frame of the installation.

According to another feature of the invention, the said circular table is constituted by removable sectors, each comprising several elements coupled with one another by means of a particularly simple, reliable and quick-coupling system which will be described in more detail later.

BRIEF DESCRIPTION OF THE DRAWINGS

The invention will be better understood and other purposes features and advantages of the latter will appear more clearly from the following explanatory description with reference to the appended diagrammatic drawings given solely by way of example illustrating an embodiment of the invention, wherein:

FIG. 3 is a perspective partial view showing how the tubes are anchored to the lower portion of the core;

DETAILED DESCRIPTION

Figure 1:
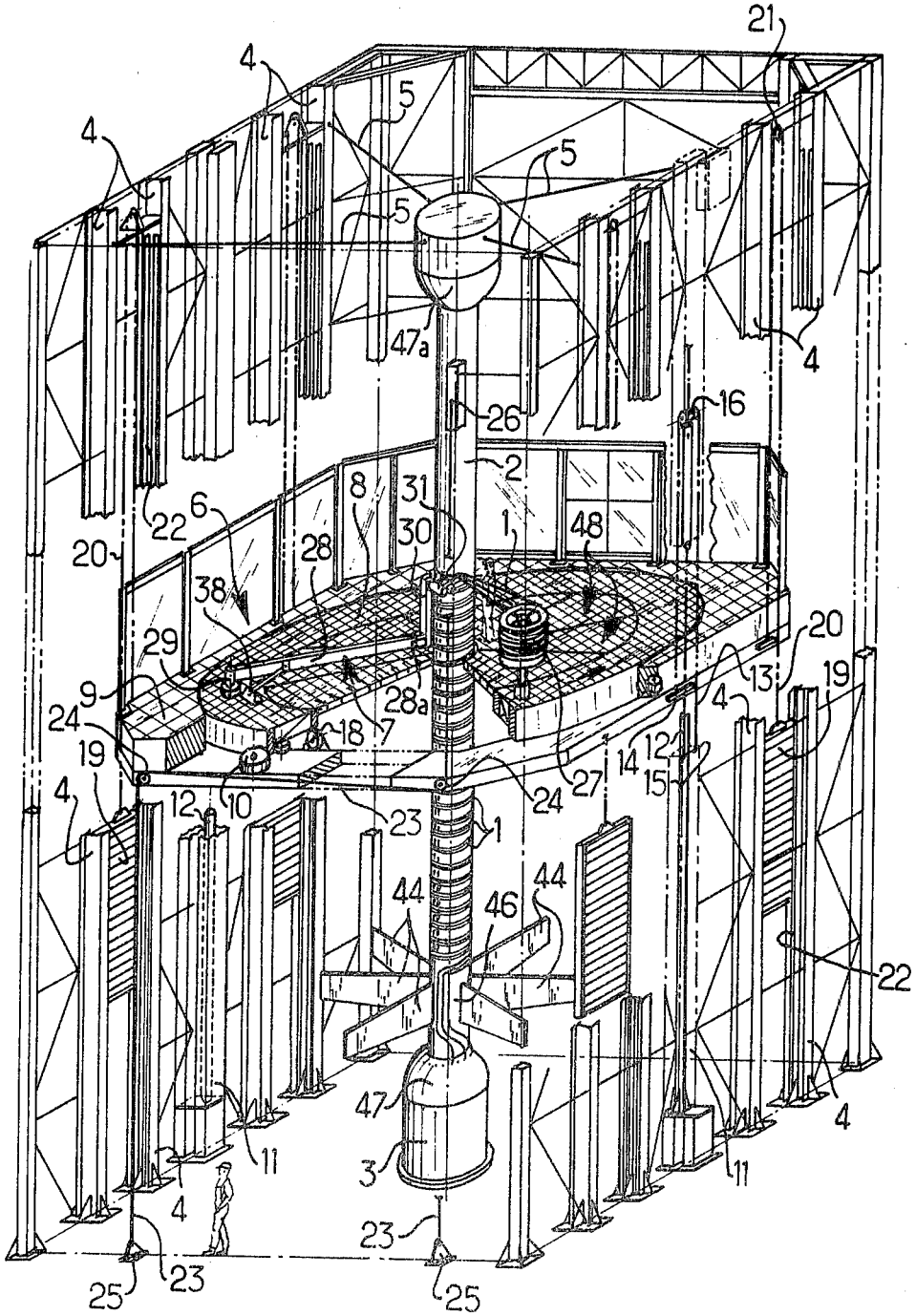
FIG. 1 is a general perspective broken-away view of the device according to the invention.
Figure 4:
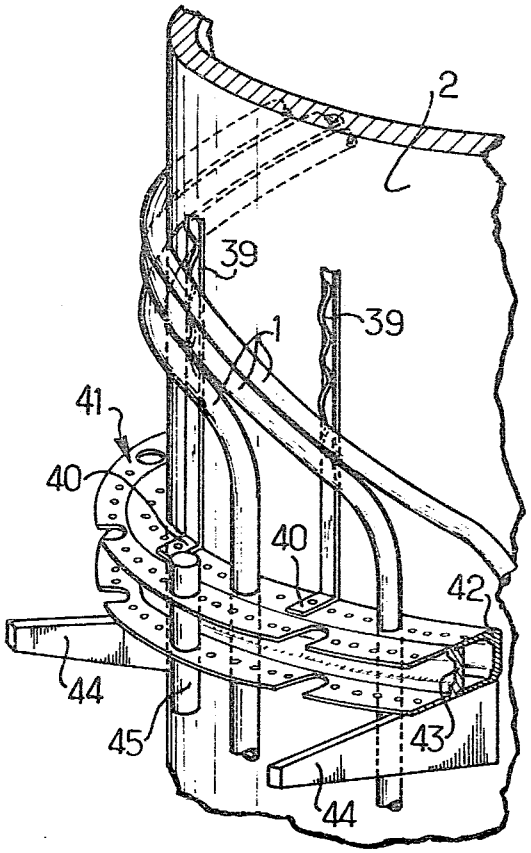
FIG. 4 is an enlarged top view of the guiding head such as shown to a smaller scale in FIG. 2.

As appears clearly from FIG. 1, the device according to the invention is intended for winding a plurality of tubes 1 around a vertically positioned core 2 secured to the ground through the medium of an appropriate support 3. The whole installation is supported by an infrastructure comprising a plurality of vertical posts 4 constituting, in a way, the frame of the installation which can thus be enclosed in a cabin or the like. The upper portion of core 2 is fixed in position by tightening ties or the like 5 attached to the posts 4 as clearly seen in FIG. 1.

Figure 2:
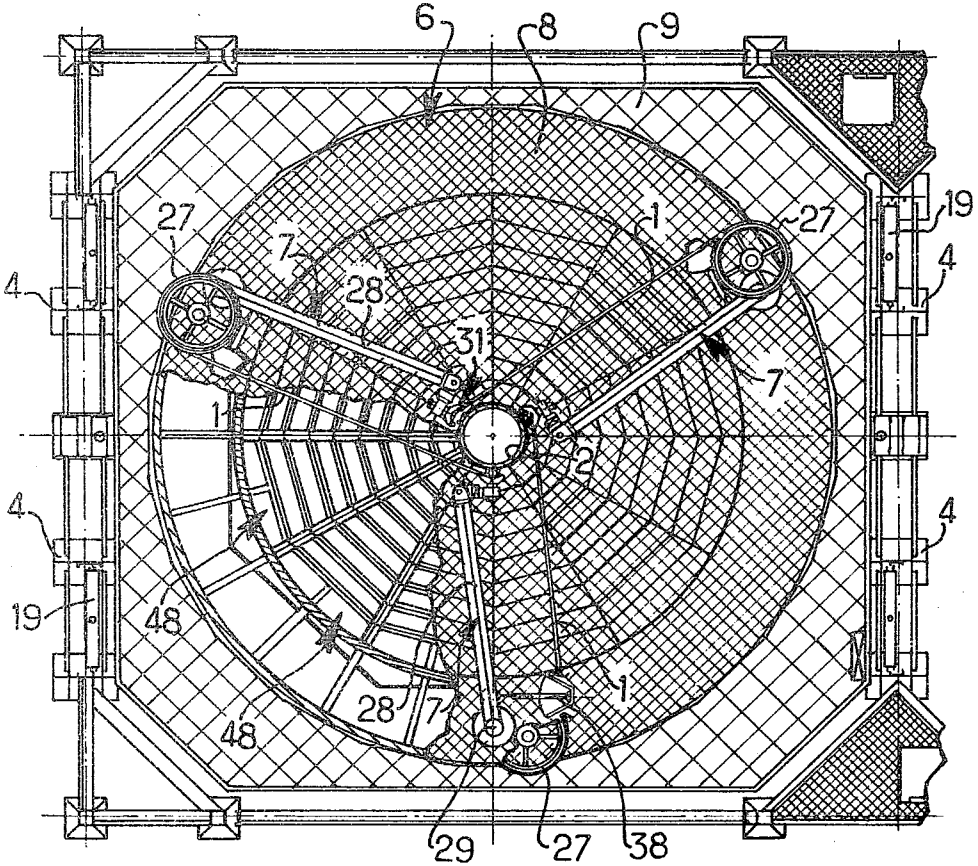
FIG. 2 is a top view of the platform of the said device.
Figure 4:
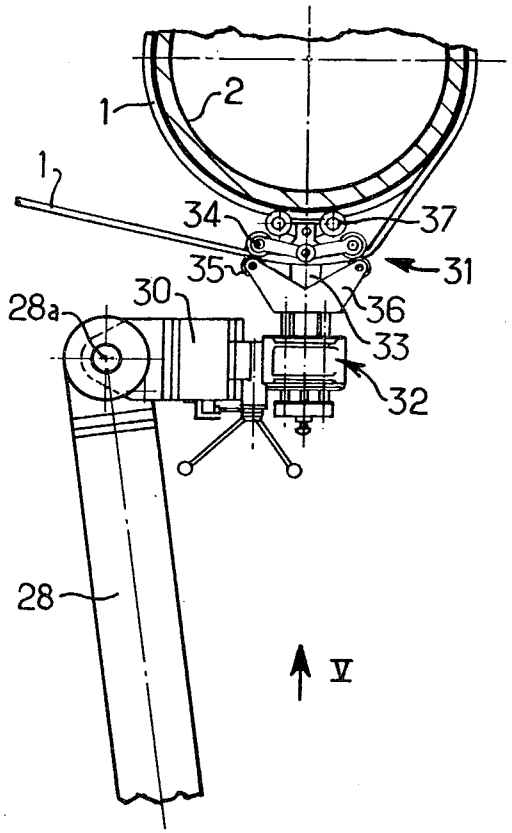

According to the example of embodiment illustrated, the device according to the invention comprises essentially a single horizontal platform 6 concentric with the core 2 and supporting preferably three winder assemblies 7 as shown in FIG. 2, it being understood that, for the sake of clarity, only one of these assemblies is represented in FIG. 1 and will be described later.

The platform 6 comprises two members, namely a circular table 8 supporting the winder assemblies 7 and which is rotatably mounted within a peripheral member or outer crown 9. The platform 6 is imparted with a combined translational and rotational movement along the core 2 as will be explained in detail herebelow.

The rotation of the table 8 is accomplished by a hydraulic motor 10 mounted on the peripheral member 9 as clearly seen in FIG. 1. It should be noted that the table 8 may be driven in either clockwise or counter-clockwise rotation to allow several tubes 1 to be wound in one direction or the other alternately. The outer crown 9 in which the table 8 rotates may be driven at variable speeds in vertical ascending or descending movement by hydraulic jacks or actuators 11 (FIG. 1) whose bodies form part of the frame of the machine and whose rods 12 drive chains or the like 13 attached between the crown 9, as shown at 14, and the body 11 of the actuators forming part of the frame of the installation, as shown at 15, it being understood that the chains 13 pass around a roller or the like 16 at the end of the rods 12, as seen in FIG. 1. The control means for the hydraulic motor 10 and the actuators 11 can be provided for example at the winder assemblies as seen at 17 in FIG. 5.

It is seen in FIG. 1 that rollers 18 are provided on the peripheral member 9 to support the circular table 8 within the peripheral member 9 which is movable vertically only.

At 19 are shown counter-weights which are slidingly movable in guide rails 22 provided in the posts 4, the said counter-weights being connected to the crown 9 through cables 20 passing around pulleys 21. The members just described advantageously ensure the guiding and vertical stability of the platform 26 during its ascending and descending motions.

The horizontal stability of the platform 6 is advantageously obtained by means of cables, chains or the like 23 passing around rollers 24 secured to the crown 9 and the ends of which are anchored to the ground as seen at 25 in FIG. 1 and to the frame of the machine as shown at 26, respectively. There can be provided at least two systems such as the one just described for horizontal stabilization of the platform 6. Such a system may advantageously be equipped with a safety braking device (not shown).

The active or working part of the machine according to the invention, namely the circular table 8 and the associated winder assemblies 7, will now be described in detail. Each winder assembly 7 comprises a reel 27 with which is associated a device for guiding the winding of the tubes 1 on the core 2. Referring more particularly to FIGS. 1, 2, 4 and 5, it is seen that the guiding device comprises a substantially horizontal arm 28 parallel with the table 8, one end 29 of the said arm being pivotally attached to the said table whereas the other end of the arm is provided with a substantially vertical or upright member 30 pivotally assembled at 28*a* to the arm 28. On the upright member 30 is slidingly ounted a guiding head 31 by means of which, as clearly appears from FIG. 4, the tubes 1 are applied and wound on the core.

More precisely, the guiding head 31 comprises a hydraulic jack or actuator 32, the rod 33 of which actuates a first set of rollers 34 which co-operate with a second set of rollers 35, mounted in a yoke or the like 36. A prebending of the tubes 1 is thus obtained as seen clearly in FIG. 4.

Furthermore, the guiding head 31 is applied on the periphery of the core 2 through the medium of a third set of rollers 37 provided at the end of the rod 33 of the actuator 32.

Shown at 38 in FIGS. 1 and 2 is another actuator, which drives the arm 28 of each guiding device, this actuator being of course secured to the rotary table 8 and allowing the guiding head 31 to be applied on the core 2.

Figure 5:
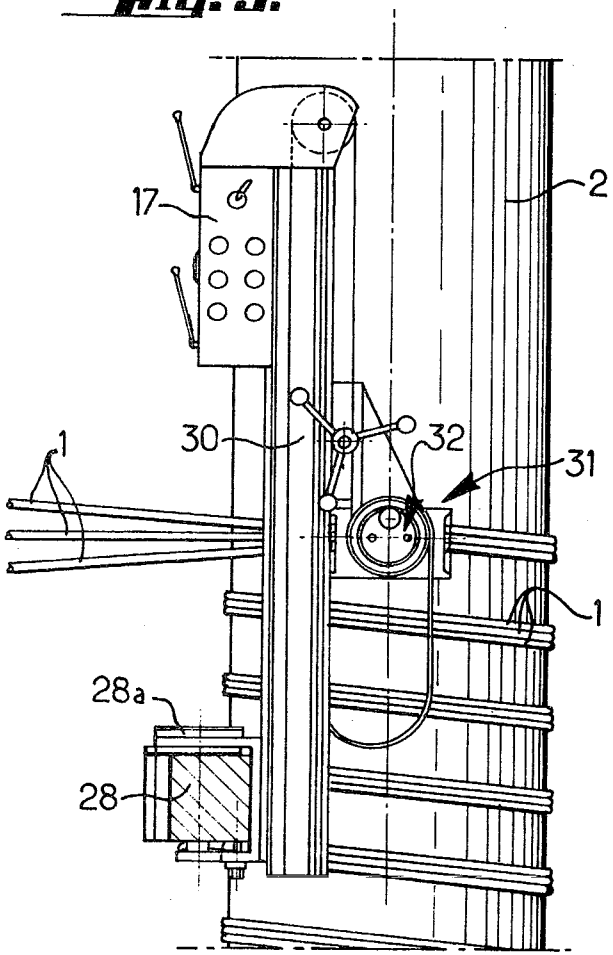
FIG. 5 is an elevational partial view in the direction of arrow V of FIG. 4.

As seen in FIG. 2, three winder assemblies are provided on the circular table 8. As seen in FIG. 5, each such assembly is capable of winding on the core 2 three tubes such as 1 at the same time. The reels with their respective guiding devices are arranged on the table 8 at an angle of substantially 120 degrees from one another. Therefore, as seen in FIGS. 3 and 5, three tubes can be wound at the same time instead of one as in the prior art. This results in a winding capacity of nine tubes during each upward motion of the platform 6. The guiding heads 31 with their rollers move on an element such as a sandow, tube or the like arranged helically around the core 2 before effecting the winding of the first layer of tubing and thereafter starting the winding of each following layer.

As seen in FIG. 3, fixing combs or like spacing supports 39 serve to retain the tubes 1 in an adequate position and are secured at 40 on a plate 41 provided at the lower portion of the core 2. The plate 41 is made up of a certain number of rings 42, 43 fitted in one another and supported by brackets such as 44 secured to the core 2. A second plate (not shown) having the same features as those just described but not supported by brackets serves to limit the winding at the upper portion of the core 2.

The said plates are particularly intended to retain the liquid which exists or is formed in the gases surrounding the tubes. At 45 there is shown an overflow pipe limiting the level of the liquid.

As seen in FIG. 1, the lower end of the tubes 1 is connected by a section 46 to a tubular plate 47 into an orifice of which they open sealingly. The same type of arrangement is provided at the upper end of the core 2.

The circular table 8 is so designed that it can be rapidly dismantled in its central portion traversed by the core 2 in order to allow the inner diameter of the said table to be adapted as quickly as possible to the diameter of the coil being formed on the core as the said coil diameter is increased by the tubing layers wound successively.

Figure 7:
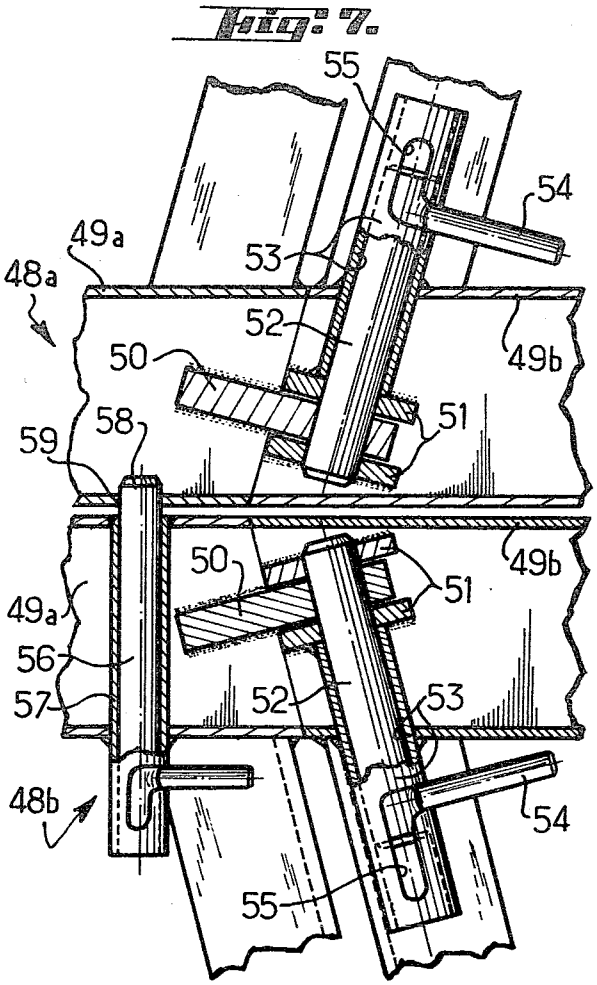
FIG. 7 is an enlarged horizontal sectional view of the encircled portion VII of FIG. 6.
Figure 6:
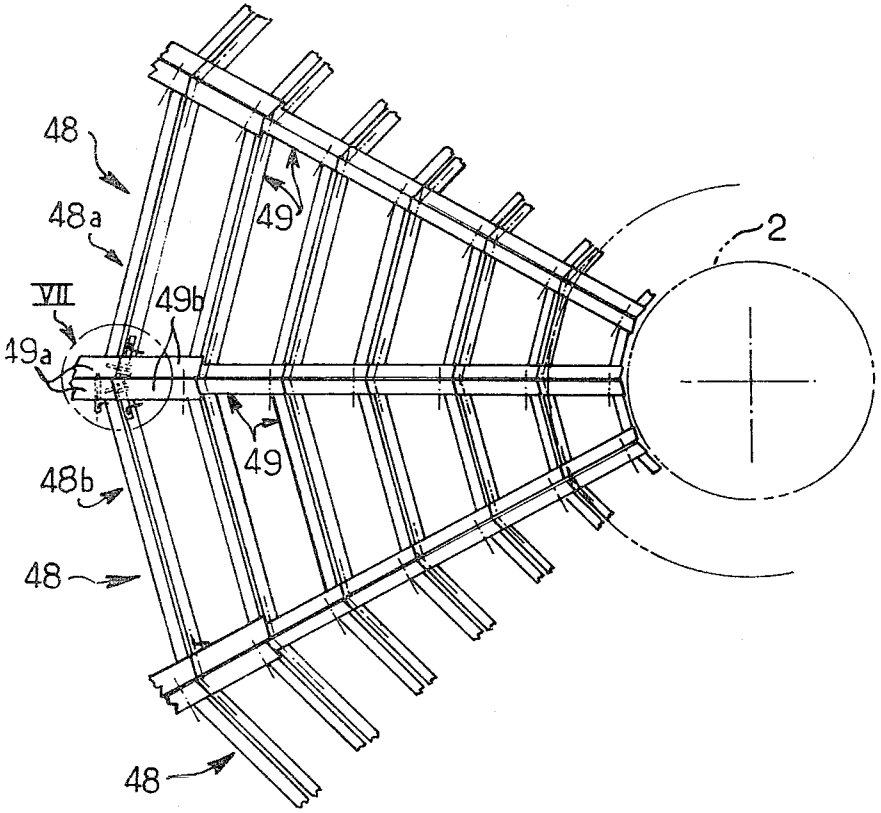
FIG. 6 is an enlarged and partial top-view of the removable sectors constituting the circular table seen in FIGS. 1 and 2.

To this end and as seen in FIGS. 1, 2 and 6 the rotary table 8 comprises removable sectors 48, each of which is constituted by several removable elements such as 49. As seen in FIGS. 6 and 7, these elements are interlockable by means of a flat-iron strip 50 secured to one (**49*a*) of the elements, which flat-iron strip passes between two flat-iron strips 51 welded to the adjacent element 49*b*. More precisely, the interlocking of the flat strips 50 and 51 is ensured by a pin 52 sliding within a pipe 53 secured, e.g., welded, to one of the flat strips 51. The pin 52 is provided with a handle or the like 54 which is movable in an aperture 55 of the pipe 53 so as to conveniently lock together or unlock from one another the elements 49*a* and 49*b***.

As seen clearly in FIG. 7, each of the adjacent elements **49*a* and 49*b* pertaining to a sector 48*a*, 48*b* are also removably connected by a pin 56 sliding within a pipe 57 secured to an element of a sector, and the end 58 of which can be engaged into an orifice 59 provided in an element such as 49*a* of the adjacent sector. The structure of the circular table 8** thus remains particularly rigid while at the same time being conveniently dismountable.

The operation of the device according to the invention is readily inferred from the foregoing description and will be briefly described hereafter.

Each reel 27 is provided with three tubes 1 of a length corresponding to the helix to be obtained, taking into account the connection to the tubular plates 47 and **47*a*. As seen in FIG. 1, the tubes 1** are actually placed on three superposed reels.

The tubes are partially paid off and introduced into the associated guiding head 31.

It is noted that the end of the tubes has previously been shaped to an adequate size to allow it to take its place through the medium of the section 46 on the corresponding tubular plate. The nine tubes being thus attached to the three winders, the winding can be started.

As has already been mentioned, the winding takes place simply as a result of the translational and rotational movement of the platform 6 or, more precisely, by the vertical movement of the outer crown 9 in which the circular table 8 supporting the winder assemblies 7 rotates. Thus, owing to a simple upward movement of the platform 6 through the whole height of the core 2, a layer of tubing is wound around the said core. Of course, the operation may be repeated several times, if desired, by causing the platform to rotate alternately clock-wise and counter-clockwise so as to form several layers of tubing superposed in intercrossing (i.e., oppositely turned) layers.

It will be noted that the platform 6 can be controlled independently from several different control points located for example at the winders, as shown in FIG. 5, or on the ground, or directly on the platform 6.

The invention therefore provides a highly reliable device for winding tubes around the core and allows high-rate manufacturing of high-quality heat exchangers wherein the tubes are wound in either or both directions at any desirable winding angle, which tubes can be made of any desired metal or alloy, e.g., stainless.

Of course, the invention is by no means limited to the forms of embodiment described and illustrated which have been given by way of example only. In particular, it comprises all the means constituting technical equivalents to the means described as well as their combinations, within the scope of the following claims.

What is claimed is:

1. A device for winding at least one tube around a substantially vertical and stationary core, comprising:

a substantially horizontal platform assembly displaceably mounted around said core, said platform assembly comprising a substantially horizontal non-rotatable vertically movable outer member and a substantially horizontal circular table rotatably mounted within said outer member and around said core for rotation around said core;

means for rotating said circular table relative to said outer member;

means for vertically moving both said outer member and said circular table relative to said core; at least one winder assembly mounted on said circular table for substantially spirally winding said at least one tube on said core; whereby simultaneous operation of said rotating means and moving means produces a simultaneous translational and rotational movement to said platform assembly relative to said core to substantially spirally wind said at least one tube around said core; and guiding means associated with said winder assembly for guiding said at least one tube during said winding, said guiding means including:

a substantially horizontal arm having one end pivotally connected to said circular table;

a substantially vertical or upright member pivotally connected to the other end of said substantially horizontal arm; and a guide head slidingly mounted on and movable along said upright member, said guide head comprising a hydraulic jack having a rod, and roller means connected to said rod and adapted to simultaneously prebend said at least one tube before being wound around said core and to guide said at least one tube being wound about said core.

2. The device of claim 1 wherein said roller means comprises a first set of rollers actuated by said rod of said hydraulic jack, and a second set of rollers mounted in a yoke and cooperating with said first set of rollers to prebend said at least one tube before being wound around said core.

3. The device of claim 2, wherein said roller means further include a third set of rollers provided at the end of said rod of said hydraulic jack for engaging the periphery of said core.

4. The device of claim 1 wherein said roller means includes a set of rollers provided at the end of said rod of said hydraulic jack for engaging the periphery of said core.

5. The device of claim 1 wherein said circular table comprises a plurality of removable sections at the central portions of said circular table to adapt said circular table to different size cores.

6. The device of claim 5, wherein said removable sections of said circular table each comprise removable elements having interlocking means and locking means for selectively locking said interlocking means together.

7. The device of claim 6, wherein said locking means comprises a pin selectively passing through a pair of flat-iron strips secured to a removable section as well as a flat-iron strip secured to the adjacent section and located between a pair of sections, and a pipe secured to said flat-iron strips through which said pin is slidably movable.

8. The device of claim 6, wherein said locking means comprises a pipe means secured to a section of said circular table and a pin slidably movable within said pipe means and whose end is selectively engageable in an orifice provided in one of said adjacent sections.

9. The device of claim 1, wherein said vertically movable outer member completely surrounds the outer periphery of said circular table, said circular table being rotatably mounted within said outer member.

10. The device of claim 9, further comprising roller means connected to said outer member for rotatably supporting said circular table.

11. The device of claim 1, wherein each winder assembly comprises a reel associated with said guiding means.

12. The device of claim 11, wherein said guide head receives said at least one tube from said reel.

13. The device of claim 1, wherein said at least one winder assembly includes means for winding a plurality of tubes around said core.

14. The device of claim 1, comprising three winder assemblies mounted on said platform, each winder assembly being positioned on said platform with a spacing corresponding to an angle substantially equal to 120° therebetween.

15. The device of claim 14, wherein each of said winder assemblies comprises means for simultaneously winding three tubes on said core.

16. The device of claim 1, further comprising rollers, or the like, mounted on said outer member; and cables or chains passing around said rollers or the like, the ends of said cables or chains being anchored to the ground and to the frame of said winding device, respectively, thereby improving the horizontal stability of said platform.

17. The device of claim 1, wherein said means for rotating said circular table relative to said outer member comprises a hydraulic motor mounted on said outer member and coupled to said circular table; and wherein said means for vertically moving said outer member comprises cable means coupled to at least one of said circular table and outer member.

18. The device of claim 17, further comprising control means for said hydraulic motor and cable means provided on one of said winder assemblies.

19. The device of claim 1, further comprising stabilizing means coupled to said circular table and a frame surrounding said winding apparatus, said stabilizing means comprising a plurality of pulleys mounted on said frame, cable means passing around said pulleys and stabilizing elements coupled to said cable means and being slidably movable relative to said frame.

20. The device of claim 19 wherein said stabilizing elements comprise counter-weights.

* * * * *